US006398122B1

(12) United States Patent
Kowalyk et al.

(10) Patent No.: US 6,398,122 B1
(45) Date of Patent: Jun. 4, 2002

(54) NO HAND COMPROMISE RAIL

(75) Inventors: Peter M. Kowalyk, Winnipeg; Douglas J. Finigan, Calgary, both of (CA)

(73) Assignee: Progress Rail Transcanada Corporation, Albertville, AL (US)

( * ) Notice: Subject to any disclaimer, the term of this patent is extended or adjusted under 35 U.S.C. 154(b) by 0 days.

(21) Appl. No.: 09/785,889

(22) Filed: Feb. 16, 2001

(51) Int. Cl.[7] ..... E01B 11/00
(52) U.S. Cl. ..... 238/167
(58) Field of Search ..... 238/122, 125, 238/151, 165, 167, 172, 175; 105/178; 104/33

(56) References Cited

U.S. PATENT DOCUMENTS 674,228 A * 5/1901 Wharton ..... 238/167
2,209,725 A * 7/1940 Bourland ..... 238/167

OTHER PUBLICATIONS

Compromise Rails Drawing 136 lb. to 115 lb. rail Apr. 6, 1999.

* cited by examiner

*Primary Examiner*—Mark T. Le
(74) *Attorney, Agent, or Firm*—Bracewell & Patterson, L.L.P.

(57) ABSTRACT

A railroad track has a heavier rail section and a lighter rail section. Compromise rails join the heavier and lighter rails. Each compromise rail has a head with a heavier end to match the profile of the heavier rails and a lighter end to match the profile of the lighter rails. Each compromise rail is symmetrical about a straight center line extending from one end to the other. The width of the compromise rail tapers uniformly from the lighter end to the heavier end. This results in a slightly different gauge along the compromise rail section from the standard gauge. The different gauges are accommodated by adjusting the gauge at an end portion of the lighter rail section and at an end portion of the heavier rail section.

20 Claims, 3 Drawing Sheets

NO HAND COMPROMISE RAIL

TECHNICAL FIELD

This invention relates in general to railroad tracks, and in particular to a compromise rail that joins a lighter rail to a heavier rail.

BACKGROUND OF THE INVENTION

Conventional railroad track has a base and a head connected by a web. The rail cars roll on the head, and the base is fastened to ties. There are a variety of different weights of rails, each different weight resulting in different cross-sectional dimensions. A heavier rail has a wider head and a wider base as well as a greater height from the bottom of the base to the head. Some railroad track systems will have light sections as well as heavy sections. For example, heavier sections may be utilized on curves, where the wear is more pronounced. Even though heavier, the curved sections may need replacement more frequently than the lighter straight track portions. Because the light and heavy sections have different cross-sections, a mismatch occurs. If the mismatch is beyond a certain selected tolerance, a compromise rail will be placed between the heavier and lighter rails. The compromise rail of the prior art has one end with a profile that matches the lighter rail sections and another end with a profile that matches the heavier rail sections. The width of the head will be greater at the heavier end than at the lighter end.

The distance or gauge between the inside surfaces of the heads of the lighter section rails will be the same as that of the heavier section. In the prior art, compromise rails have been machined asymmetrically so that the widened portion will be on the outside surface of the head. This allows the inside surface of the head of the compromise rail to remain at the same gauge. Since the widened portion is on the outside of the rail, there will be a difference between the compromise rail for the left-hand side of the track and one for the right-hand side of the track. This requires an inventory of two different compromise rails for each type of compromise rail section.

SUMMARY OF THE INVENTION

The compromise rail of this invention is interchangeable between right and left sides. The compromise rail has a head with a greater width on a heavier end of the rail and a lesser width on the lighter end of the rail. The head is symmetrical about a longitudinal center line, and tapers continuously in width from the lighter end to the heavier end. The symmetry of the head about the center line allows it to be used with either the right or the left side of a compromise track section.

During the installation, the end portions of the lighter rail section and the heavier rail section may be laterally adjusted slightly engaged so as to allow the ends of the compromise rail to abut flush with both the ends of the heavier and lighter rail sections. In making the adjustment, the gauge of the end portion of the lighter rail section may be increased slightly over the standard gauge, while the gauge of the end portions of the heavier rail section may be slightly decreased from the standard gauge. Since the heads of the heavier and lighter rails differ in width only in fractions of an inch, the difference in gauge at the lighter and heavier end portions is slight, and this difference from standard gauge is spread over the length of the compromise rail.

The width of the base of the compromise rail also changes from the lighter end to the heavier end. The change in width is also symmetrical about a longitudinal center line, however it may occur over a relatively short intermediate section. Similarly, a change in height of the rail will be made, but it may be made on a relatively a short intermediate section.

DESCRIPTION OF THE INVENTION

Figure 1:
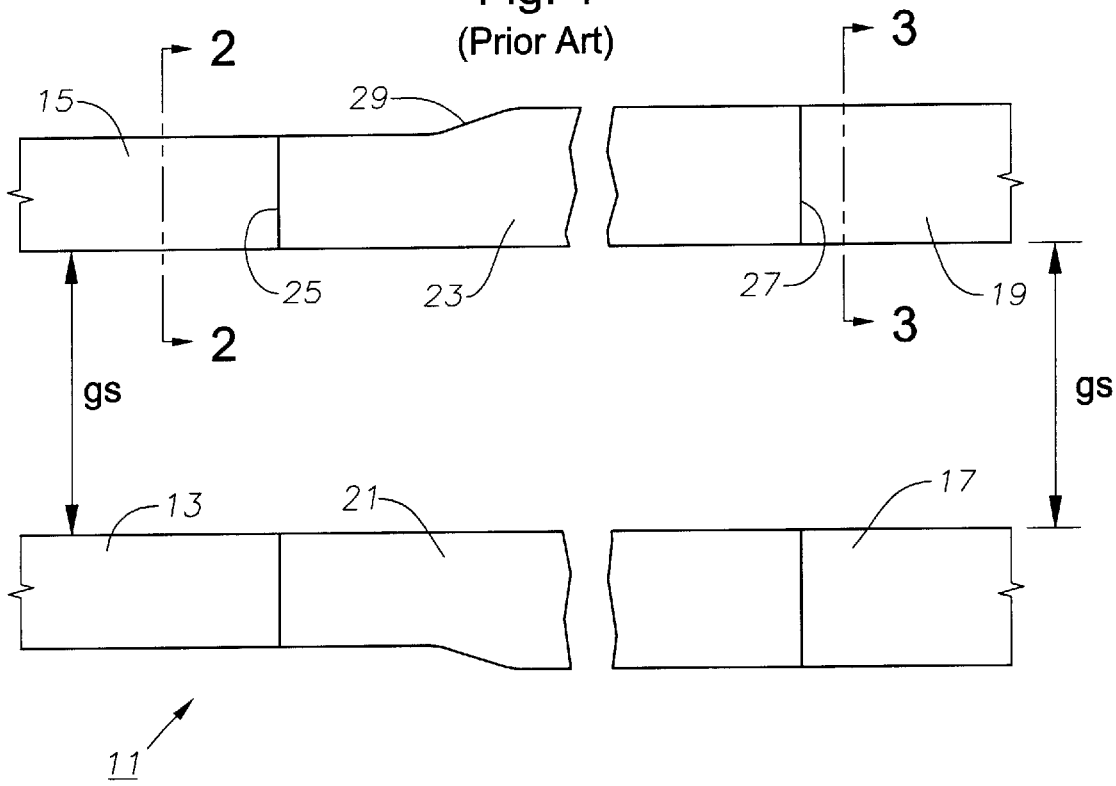
Fig. 1 (Prior Art)
FIG. 1 is a schematic plan view showing heads of prior art compromise rails connected between lighter and heavier rail sections.
Figure 2:
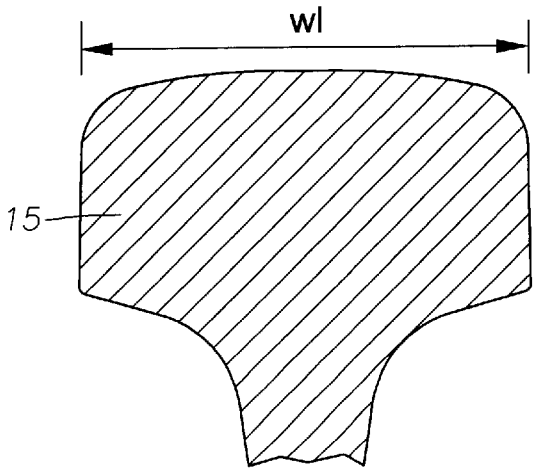
Fig. 2 (Prior Art)
FIG. 2 is a sectional view of one of the lighter rails of FIG. 1, taken along the line 2—2 of FIG. 1.
Figure 3:
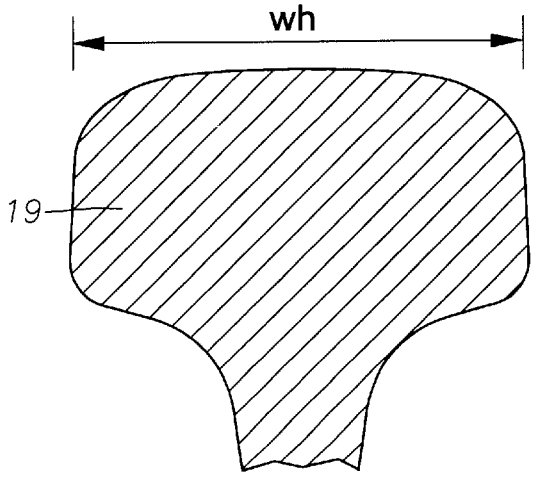
Fig. 3 (Prior Art)
FIG. 3 is a sectional view of one of the heavier rails of FIG. 1, taken along the line 3—3 of FIG. 1.

Referring to the prior art example of FIG. 1, railroad track 11 has a lighter rail section having lighter rails 13, 15. For clarity, only the heads of rails 13, 15 are shown in FIG. 1, with the bases being removed. Railroad track 11 also has a heavier rail section with heavier rails 17, 19. Lighter rails 13, 15 are identical to each other, and heavier rails 17, 19 are identical to each other. As indicated in FIGS. 2 and 3, the width wl of the head of either rail 13, 15 is less than the width wh of either heavier rail 17 or 19. The difference in widths wh, wl depends upon the weight per foot of the particular rails 15, 19, and the difference is not very large. For example, for a 136 lb. rail, the width of the head is $2\frac{15}{16}$", while a 115 lb. rail has a head width of $2\frac{23}{32}$". Nevertheless this mismatch must be accounted for. In all of the drawings, the difference in widths is exaggerated over what actually occurs.

The gauge gs in FIG. 1 refers to the distance between the inside surface of rail 13 to the inside surface of rail 15. The same gauge gs exists with the heavier rails 17, 19. This gauge for the purposes herein is considered to be a standard gauge although it could be of various dimensions depending upon the location of the railroad track. A compromise rail 21 joins lighter rail 13 to heavier rail 17, this compromise rail being considered the left-hand rail. A left-hand compromise rail 23 joins lighter rail 15 with heavier rail 19. Each compromise rail 21, 23 has a lighter end 25 and a heavier end 27. Each compromise rail 21, 23 has a transition section 29 wherein the head width of lighter end 25 tapers to the greater width of heavier end 27. This transition section 29 occurs on the outer side of each compromise rail 21, 23 and over a fairly short distance.

Placing the transition section 29 only on the outer sides allows the inner sides of compromise rails 21, 23 to remain in a straight line at the constant gauge gs. However, it results in the compromise rails 21, 23 being mirror images of each other, not identical. Being asymmetrical, there will be a right-hand compromise rail 21 and a left-hand compromise rail 23 for each track section between lighter rail sections and heavier rail sections.

Figure 4:
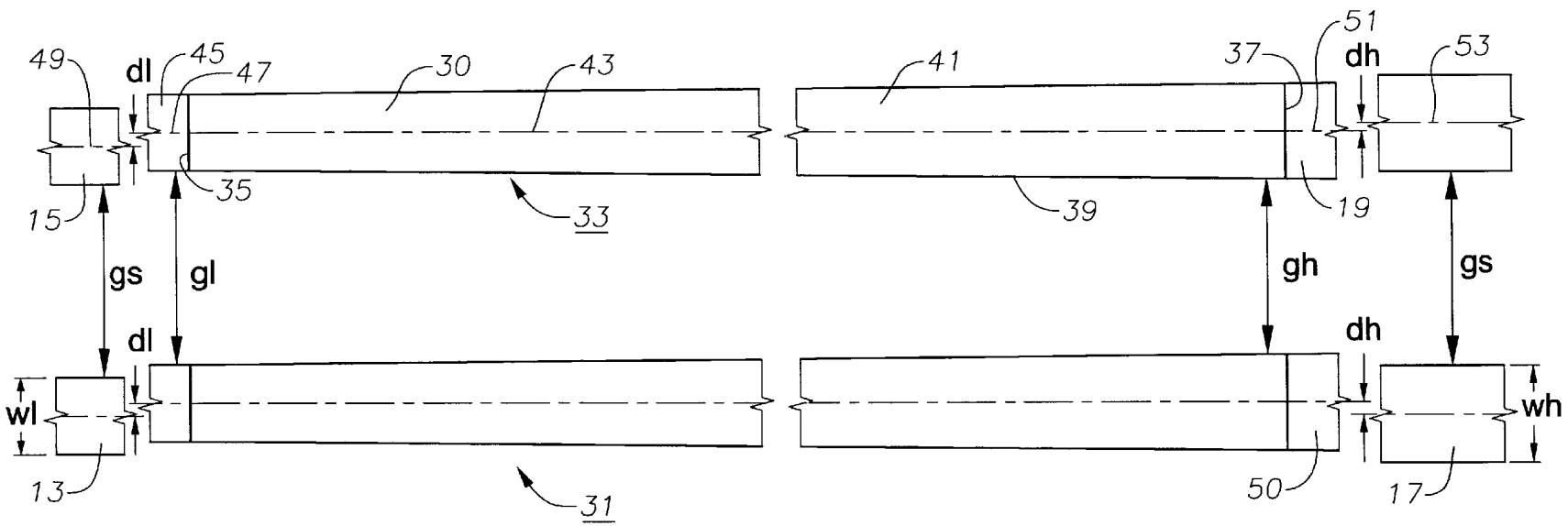
FIG. 4 is a schematic plan view of the heads of a pair of compromise rails constructed in accordance with this invention, and shown connected between heavier and lighter rails.

Referring to FIG. 4, the heads 30 only of compromise rails 31, 33 of this invention are shown connected between the lighter and heavier rail sections. Compromise rails 31, 33 are preferably identical to each other and thus interchangeable with each other. There is no "hand", such as a right-hand and a left-hand. Each compromise rail 31, 33 has lighter end 35 and a heavier end 37. The lighter ends 35 have substantially the same profiles as lighter rails 13, 15 and are joined to them. Heavier ends 37 of compromise heads 31, 33 have the same profiles as heavier rails 17, 19 and are joined to them. The head 30 of each compromise rail 31, 33 has an inner side 39 and an outer side 41 that are straight and taper from each other in a diverging manner from lighter end 35 to heavier end 37. A single, straight center line 43 extends from lighter end 35 to heavier end 37, equally bisecting sides 39, 41. Sides 39, 41 taper continuously from center line 43 at the same rate throughout the length. This results in each compromise rail 31, 33 being symmetrical about center line 43.

The length of compromise rail 31, 33 is fairly long, preferably 18 feet or more. Since the difference in widths wl and wh are only a fraction of an inch, this variance is not very significant over the entire length. However, some adjustment to the gauge must occur at least at one of the ends 35, 37. For example, if lighter ends 35 are simply joined to end portions 45 of lighter rails 13, 15 with the gauge remaining standard at the point of joining, the gauge at the heavier end 37 would be less than standard because of the taper of the width of each head 30. Also, a mismatch between heavier ends 37 and heavier rails 17, 19 would occur.

Preferably, the gauge is adjusted at both heavier ends 37 and lighter ends 35 so that the welded connections between compromise rails 31, 33 and lighter and heavier rail sections can be flush. This may be accomplished at the lighter track section by moving the end portions 45 of the lighter rails 13, 15 farther apart from each other slightly, resulting in a slightly larger gauge gl than the standard gauge gs. Each rail of the lighter end portion 45 has a center line 47 that will be offset slightly from the center line 49 in the standard portion of the lighter rails 13, 15. Center line 47 will coincide with center line 43 of compromise rail 31, 33 where they join. End portions 45 will be bent outward from each other slightly, but over a significant length, such that the variance may be no more than about ¼" over about ten feet.

Similarly, the gauge gh of end portion 50 of the heavier rails 17, 19 will be decreased slightly. A center line 51 of the heavier section end portion 50 will coincide with compromise rail center line 43 where end 37 joins. Center line 43, however, will be offset from center line 53 located in the standard section of the heavier rails 17, 19. The gauge gh will be slightly less than the standard gauge gs. The amount of difference between gh and gs is two times dh, which is the difference in the positions of the center line 51, 53. The difference between standard gauge gs and increased gauge gl is also twice the distance dl, which is the difference between center lines 47, 49. Heavier section end portion 50 will be bent inward toward each other slightly over a selected length so as not to exceed tolerances of about ¼" and ten feet. The amount of increase in gauge gl relative to standard gauge gs will be proportional to the differences in widths of the heavier rail sections 17, 19 and lighter rail sections 13, 15. Preferably, the width wh of heavier section 17 or 19 less the width wl of lighter section 13 or 15 divided by four will be the difference between gl and gs. Similarly, the difference between gs and gh is also equal to wh less wl divided by four. The difference between standard gauge gs and the increased and the decreased gauges gl, gh is not very much and is within standard tolerances for maintaining standard gauge. For example, the difference in the case of 136 lb./ft. of heavier rails 17, 19 and 115 lb./ft. lighter rails 13, 15 results in difference between gs and gl of 7/32" over the 18 ft. length. A tolerance of ⅛" is normally acceptable.

Figure 5:
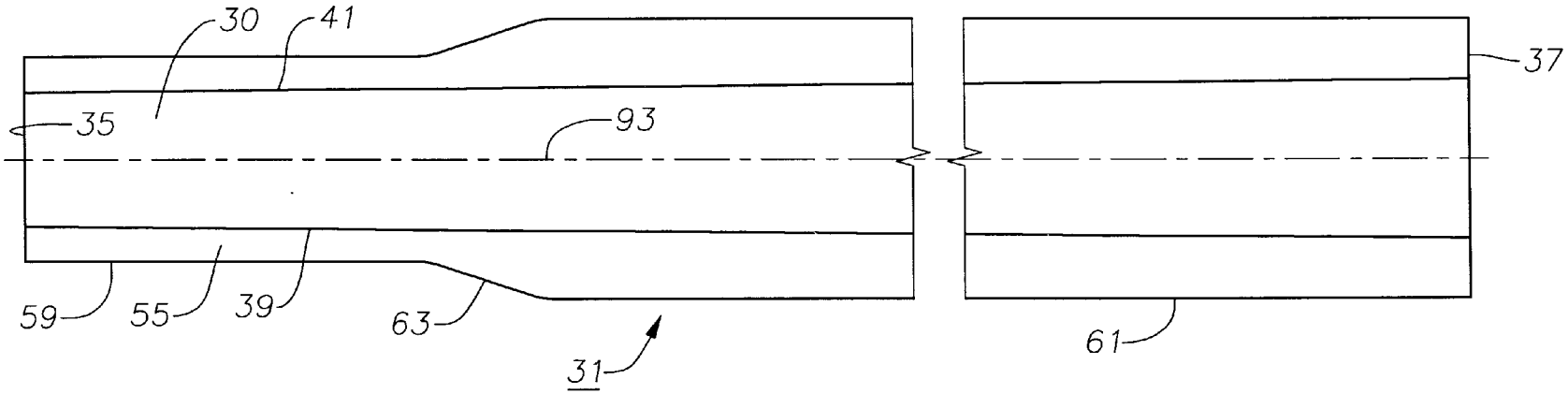
FIG. 5 is a plan view of one of the compromise rails of FIG. 4, showing also the base.

Referring to FIG. 5, compromise rail 31 has a base 55. Base 55 is a flange that connects head 30 by means of a vertical web 57. Base 55 has a constant width section 59 that has the same width as the base (not shown) of lighter rails 13, 15. Base 55 has a greater constant width section 61 that has the same width as the base (not shown) of the heavier rails 17, 19 (FIG. 4). An intermediate section 63 joins the lesser width section 59 to the greater width section 61. Intermediate section 63 tapers from one section to the other. Unlike the taper of the width of head 30, which takes place over the entire length, intermediate 63 may be fairly short, taking place over only a few inches. Constant base width sections 59, 61 extend for several feet. The increase in width is symmetrical and occurs on both sides of center line 43.

Figure 6:
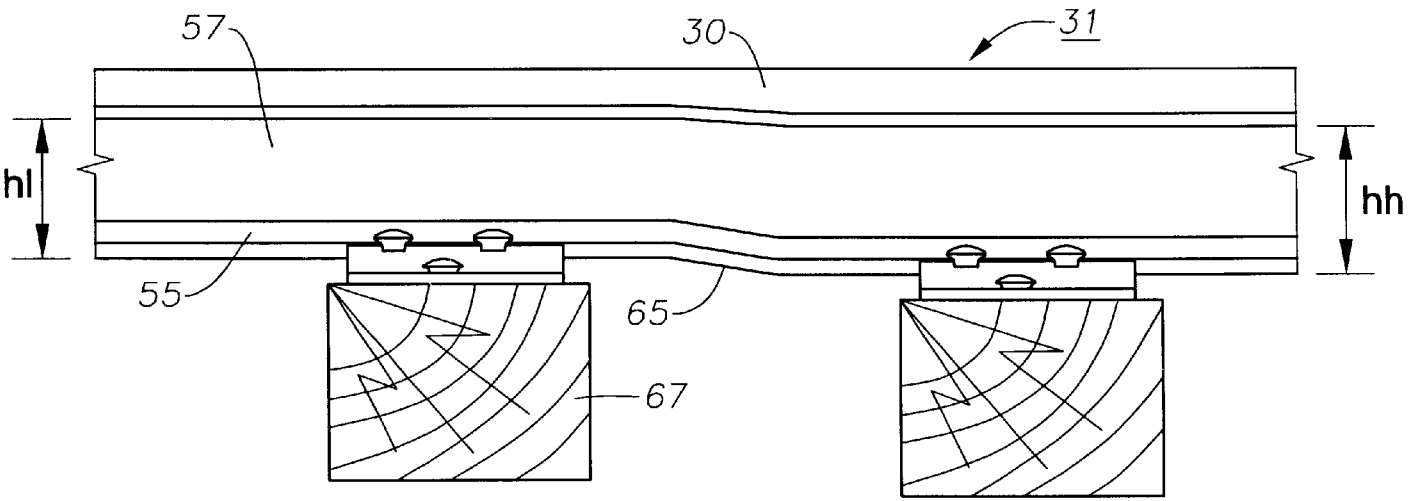
FIG. 6 is a side elevational view of a portion of one of the compromise rails of FIG. 4.

Referring to FIG. 6, the height hl refers to a dimension from the bottom of base 55 to lower side of head 30 of compromise rail 31. The vertical dimension hh refers to the distance from lower side of base 55 to the lower side of compromise rail 31. The dimension hh at the heavier end of compromise rail 31 is greater than at the lighter end. The difference in height may occur over a fairly short intermediate section 65. Intermediate section 65 is only a few inches long and may coincide with intermediate section 63. The portion to the left of intermediate section 65, as shown in FIG. 6, is of a constant height hl, while the portion to the right is of a constant height hh.

The difference in height is accommodated by lifting the rail ties 67 so that the top of compromise rail 31 remains in constant elevation. Although not shown, in some cases, the tops of compromise rails 31, 33 may be tapered or ground down, resulting in a slightly greater vertical dimension of head 30 at the heavier end 37 than at the lighter end 35. This is done so as to match the profile at the lighter end 35 with worn lighter rails 13, 15. Preferably, this machining occurs over the length of the compromise rail 31 or 33 to provide a smooth transition.

In operation, workmen will attach compromise rails 31, 33 to one of the rail sections, either the heavier section or the lighter section. Assuming that the lighter ends 35 are welded first, the workmen will preferably loosen some of the connections of the lighter end portion 45 to the rail ties 67 (FIG. 6) and slightly increase the gauge to the gauge gl. Preferably, the gauge gl is greater than standard gauge gs an amount approximately equal to the difference between the widths wh and wl divided by four. Similarly, the end portions 50 of the heavier rails 17, 19 will be bent slightly toward each other to a gauge gh that is less than standard gauge gs by approximately the same amount that the gauge gl is greater than the gauge gs. After adjusting, the end portions 45 and 50 are secured to ties 67. The gauge of the compromise rail 31, 33 will differ slightly along the lengths from the larger gauge gl to the smaller gauge gh. The difference, however, should be within standard tolerances.

The invention has significant advantages. The symmetrical compromise rails allow one to join heavy and lighter sections without having to have a right hand and a left hand compromise rail. This reduces the amount of inventory by one-half.

While the invention has been shown in only one of its forms, it should be apparent to those skilled in the art that it is not so limited but is susceptible to various changes without departing from the scope of the invention.

What is claimed is:

1. A compromise rail for joining a lighter rail section to a heavier rail section, comprising:

a head having a greater width on a heavier end of the rail and a lesser width on a lighter end of the rail, the head having a straight longitudinal centerline from the lighter end to the heavier end and being symmetrical about the centerline;

a base joined to the head by a web;

wherein the base has a greater width section that has a constant width, a lesser width section with a constant width that is smaller than in the greater width section, and a width transition section between the greater width section and the lesser width section wherein the width of the base tapers; and wherein the width transition section has a shorter longitudinal length than the greater width section and the lesser width section.

2. The rail according to claim 1, wherein the width of the head tapers continuously from the heavier end of the rail to the lighter end of the rail.

3. The rail according to claim 1, wherein the rail has a length of at least 18 feet.

4. The rail according to claim 1, wherein the head of the rail has a greater vertical thickness section, a lesser vertical thickness section, and a vertical thickness transition section between the greater vertical thickness section and the lesser vertical thickness section wherein the vertical thickness of the head tapers; and wherein the vertical thickness transition section has a shorter longitudinal length than the greater vertical thickness section and the lesser vertical thickness section.

5. The rail according to claim 1, wherein the rail has greater vertical dimension section with a constant vertical dimension from a bottom of the base to a lower side of the head, a lesser vertical dimension section with a constant vertical dimension that is less than in the greater vertical dimension section, and an intermediate section between the lesser vertical dimension section and the greater vertical dimension section wherein the vertical dimension tapers; and wherein the intermediate section has a lesser longitudinal length than the greater vertical dimension section and the lesser vertical dimension section.

6. A railroad track, comprising:

a heavier rail section having a pair of heavier rails, each of the heavier rails having a head and a base joined by a web;

a lighter rail section having a pair of lighter rails, each of the lighter rails having a head and a base joined by a web, the head of each of the lighter rails having a lesser width than the head of each of the heavier rails;

a pair of compromise rails, each of the compromise rails having a head with a heavier end that is substantially the same width as the head of each of the heavier rails, the head of each of the compromise rails having a lighter end that is substantially the same width as the head of each of the heavier rails, the head of each of the compromise rails tapering in width from the lighter end to the heavier end, the head of each of the compromise rails being symmetrical about a longitudinal centerline from the heavier end to the lighter end so as to be interchangeable with one another;

the heavier ends of the compromise rails being joined to ends of the heavier rails, and the lighter ends of the heavier rail section being joined to ends of the lighter rails; wherein the base has a greater width section that has a constant width, a lesser width section with a constant width that is smaller than in the greater width section, and a width transition section between the greater width section and the lesser width section wherein the width of the base tapers;

the width transition section has a shorter longitudinal length than the greater width section and the lesser width section;

the head of the rail has a greater vertical thickness section, a lesser vertical thickness section, and a thickness transition section between the greater vertical thickness section and the lesser vertical thickness section wherein the vertical thickness of the head tapers; and the vertical thickness transition section has a shorter longitudinal length than the greater vertical thickness section and the lesser vertical thickness section.

7. The railroad track according to claim 6, wherein a gauge measured between inside surfaces of the heads of the compromise rails differs from the lighter ends of the compromise rails than at the heavier ends of the compromise rails.

8. The railroad track according to claim 6, wherein:

the heavier rail section and the lighter rail section have a standard gauge that is the same;

a gauge measured between inside surfaces of the heads of the heavier rails at an end portion of the heavier rail section is less than the standard gauge; and a gauge measured between inside surfaces of the heads of the lighter rails at an end portion of the lighter rail section is greater than the standard gauge.

9. The railroad track according to claim 6, wherein:

the heavier rail section and the lighter rail section have a standard gauge that is the same;

an undergauge portion measured between inside surfaces of the heads of the heavier rails at an end portion of the heavier rail section is less than the standard gauge; and an overgauge measured between inside surfaces of the heads of the lighter rails at an end portion of the lighter rail section is greater than the standard gauge by substantially the same amount as the undergauge portion.

10. The railroad track according to claim 6, wherein:

the heavier rail section and the lighter rail section have a standard gauge that is the same; and a gauge at the end portion of the lighter rail section less the standard gauge is substantially the same as one-fourth the width of the head of one of the heavier rails less one-fourth the width of the head of one of the lighter rails.

11. The railroad track according to claim 6, wherein each of the compromise rails has a length of at least 18 feet.

12. The railroad track according to claim 6, wherein the compromise rail has a height from a bottom of the base to a lower side of the head that is greater at the heavier end of the compromise rail than at the lighter end of the compromise rail.

13. The railroad track according to claim 6, wherein the compromise rail has greater vertical dimension section with a constant vertical dimension from a bottom of the base to a lower side of the head, a lesser vertical dimension section with a constant vertical dimension that is less than the greater vertical dimension section, and an intermediate section between the lesser vertical dimension section and the greater vertical dimension section wherein the vertical dimension tapers; and wherein the intermediate section has a lesser longitudinal length than the greater vertical dimension section and the lesser vertical dimension section.

14. A method of joining a heavier rail section of a railroad track to a lighter rail section, each rail of the heavier rail section having a head with a greater width than a head of each rail of the lighter rail section, the heavier rail section having a standard gauge that is the same as the lighter rail section, the method comprising:

providing a pair of compromise rails, each of the compromise rails having a head and a base connected by a web, the head having a heavier end that is substantially the same width as the head of each rail of the heavier rail section, each of the compromise rails having a lighter end with a head that is substantially the same width as the head of the each rail of the lighter rail section, the head of each of the compromise rails being symmetrical about a longitudinal centerline from the heavier end to the lighter end so as to be interchangeable with one another, the base having a greater width section that has a constant width, a lesser width section with a constant width that is smaller than in the greater width section, and a width transition section between the greater width section and the lesser width section wherein the width of the base tapers, the width transition section having a shorter longitudinal length than the greater width section and the lesser width section;

moving the ends of the rails of the heavier rail section a short distance toward each other relative to the standard gauge, and joining the heavier end of each of the compromise rails to one of the end of the rails of the heavier rail section; and moving the ends of the rails of the lighter rail section a short distance apart from each other relative to the standard gauge, and joining the lighter end of each of the compromise rail to one of the rails of the lighter rail section.

15. The method according to claim 14, wherein the amount of increase in gauge at the end of the lighter rail section is substantially the same as the reduction in gauge at the end of the heavier rail section.

16. The method according to claim 14, wherein the head of each of the compromise rails tapers uniformly in width from the lighter end to the heavier end.

17. The method according to claim 14, wherein the amount of increase in gauge at the end of the lighter rail section is substantially one-fourth the width of the head of one of the rails of the heavier section less one-fourth the width of one of the head of the rails of the lighter section.

18. The method according to claim 14, wherein the amount of increase in gauge at the end of the lighter rail section and the amount of decrease in gauge at the end of the heavier section are each one-fourth the width of one of the heads of the rails of the heavier section less one-fourth the width of one of the heads of the rails of the lighter section.

19. The method according to claim 14, wherein the step of providing a pair of compromise rails further comprises providing the head of each of the compromise rails with a greater vertical thickness section, a lesser vertical thickness section, and a thickness transition section between the greater vertical thickness section and the lesser vertical thickness section wherein the vertical thickness of the head tapers, and wherein the vertical thickness transition section has a shorter longitudinal length than the greater vertical thickness section and the lesser vertical thickness section.

20. The method according to claim 14, wherein the step of providing a pair of compromise rails further comprises providing each of the compromise rails with a base that is joined to the head of the compromise rail by a web, and providing each of the compromise rails with a height from a bottom of the base to a lower surface of the head that is greater at the heavier end than at the lighter end; the method further comprising:

changing an elevation of the ends of the rails of one of the rail sections so as to match an elevation of the ends of the rails of the other rail section.

* * * * *